United States Patent [19]

Straubel et al.

[11] 4,385,867

[45] May 31, 1983

[54] APPARATUS FOR POSITIONALLY FIXING A DRIVE SHAFT DISPOSED IN A FUEL INJECTION PUMP FOR INTERNAL COMBUSTION ENGINES

[75] Inventors: Max Straubel; Reinhard Schwartz; Ernst Ritter; Ilija Djordjevic, all of Stuttgart, Fed. Rep. of Germany

[73] Assignee: Robert Bosch GmbH, Stuttgart, Fed. Rep. of Germany

[21] Appl. No.: 213,711

[22] Filed: Dec. 5, 1980

[30] Foreign Application Priority Data

Dec. 6, 1979 [DE] Fed. Rep. of Germany ..... 2949100

[51] Int. Cl.[3] ..... F04B 21/00

[52] U.S. Cl. ..... 417/63; 73/119 A; 123/509; 417/313

[58] Field of Search ..... 417/313, 63, 238; 73/119 A; 123/509, 495

[56] References Cited

U.S. PATENT DOCUMENTS

| | | | |
|---|---|---|---|
| 3,702,577 | 11/1972 | Staudt | 92/15 |
| 4,190,401 | 2/1980 | Hofmann et al. | 417/313 |
| 4,322,174 | 3/1982 | Ishii et al. | 417/313 X |

FOREIGN PATENT DOCUMENTS

| | | | |
|---|---|---|---|
| 2000997 | 7/1971 | Fed. Rep. of Germany . | |
| 2605062 | 8/1976 | Fed. Rep. of Germany | 73/119 A |
| 2438313 | 4/1977 | Fed. Rep. of Germany . | |
| 1507902 | 4/1978 | United Kingdom . | |

*Primary Examiner*—Edward K. Look

*Attorney, Agent, or Firm*—Edwin E. Greigg

[57] ABSTRACT

An apparatus is proposed for positionally fixing a drive shaft disposed in a fuel injection pump for internal combustion engines in a predetermined rotary position, in particular one associated with the onset of fuel supply, and for measuring and testing this rotary position. The apparatus is provided with an apparatus into the reception bore of which either a holder element or an electric pulse transducer can be inserted. An element firmly connected with the drive shaft is provided with an angle-indicator marking, which is equipped both as a coupling element for the position-fixing apparatus and as a pulse trigger for the pulse transducer. The apparatus can thus be used both as a locking apparatus for mounting the injection pump on the engine and, with the pulse transducer inserted, as a measurement and testing apparatus.

11 Claims, 5 Drawing Figures

APPARATUS FOR POSITIONALLY FIXING A DRIVE SHAFT DISPOSED IN A FUEL INJECTION PUMP FOR INTERNAL COMBUSTION ENGINES

BACKGROUND OF THE INVENTION

The invention is based on a position-fixing device as described by the preamble to the main claim.

In fuel injection pumps of the series type, it is necessary to measure the supply onset position, for instance, or a rotary position corresponding to supply onset, of the first cam (that is, the first cam after the drive means) of the camshaft which here serves as the drive shaft, and subsequently to fix the camshaft in position in order to be able to mount the injection pump on the appropriately readied internal combustion engine. In the case of fuel injection pumps of the distributor type, the drive shaft is fixed in the rotary position in which a predetermined recess begins to perform supply, or else it is held blocked in a position which is displaced by a constant amount from this rotary position.

In order to identify this supply onset position which is ascertained on the test bench, it is known to place a second slash mark on the end face of the pump which agrees with a first slash mark on some element which is firmly connected with the drive shaft, or to provide a slash mark on the movable element if the fixed mark is located on the pump housing. This known manner of initial adjustment has the grave disadvantage, among others, that the slash marking either cannot be seen from outside, or is difficult to see, if the pump is mounted with an end flange on the gear boxes of the engine. It this case, it is frequently necessary to search for the supply onset once again after the pump has been mounted on the engine. This can be done by the so-called "overflow method", in which with the pressure valve removed the pump suction chamber is placed under fuel pressure and the pump is slowly pivoted, with the drive shaft coupled to it and fixed in position, until the pump piston closes the intake bore during its upward stroke and the fuel ceases to flow out. In this position, the injection pump is firmly screwed to the engine, which is already set to supply onset. This adjustment is very wasteful of time and can be performed only by experienced technical personnel. However, even when the slash mark is accessible, the accuracy of this adjustment done while the pump is being mounted on the motor depends to a considerable extent on the skill of the mechanic.

Devices of the general type described by the preamble to the main claim are also known (from the German Offenlegungsschrift No. 20 00 997) or corresponding U.S. Pat. No. 3,702,577 in which the holder pin of an apparatus which is positionally fixed relative to the pump housing is pressed, in the manner of an index pin, into a notch on the circumference of an element connected with the camshaft of the injection pump, in order to lock the camshaft in the supply onset position until it is mounted on the engine. This apparatus serves solely as a means of securing the camshaft in the supply onset position while it is moved, and also makes it possible to reproduce this position later; however, this position is associated only with the "static supply onset".

However, since when the engine is running the "dynamic supply onset" differs from the static supply onset ascertained by the overflow method, it is desirable to be able to establish or subsequently test the dynamic supply onset of the injection pump, preferably at a fixed rpm, not only during initial adjustment at the factory but also when the pump is mounted on the engine and when it is later tested in service (in the course of repairs). Here, again, the supply onset position must be mechanically fixed in order to mount the injection pump on the engine. With known testing and position-fixing devices, this can be realized either not at all or only at great expense in terms of time and cost.

OBJECT AND SUMMARY OF THE INVENTION

The position-fixing apparatus according to the invention having the characteristics of the main claim has the advantage over the prior art that the supply onset, or a rotary position of the camshaft associated with the supply onset, can be dynamically ascertained on the test bench by means of the electric pulse transducer, which functions in a non-contacting manner and can be inserted into the apparatus housing in place of the holder element; then the apparatus can be fixed in this position and the drive shaft, located in the prescribed rotary position, can be locked in position by means of reinsertion of the holder element until the pump has been mounted on the engine. On the engine, with the holder element removed and the electric pulse transducer reinserted, the correct supply onset or the rotary position of the drive shaft associated with correct supply onset can then be checked merely by comparing the rotary-position pulse emitted by the pulse transducer with a signal picked up on the engine on the basis of the top-dead-center mark associated with top dead center of the crankshaft. This is equally possible in the course of servicing, without great measurement expense, because when the pump is mounted on the engine a supply-onset pump no longer needs to be measured. As a result, it is possible to preclude a relatively large number of sources of error which would otherwise exist. Although in practice the top-dead-center mark is fixed, for reasons of uniformity and efficiency, at a crankshaft angle of 20°, for instance, after top dead center so that it will not coincide with a instant of ignition or supply onset, it is nevertheless called a "top-dead-center" or "TDC" mark and will be so designated in this specification.

As a result of the characteristics disclosed in the dependent claims, advantageous modifications of and improvements to the positional fixing apparatus disclosed in the main claim are possible. Although bores or depressions in a cylindrical, revolving element can serve as angle-indicator markings, the characteristics disclosed in claim 2 still serve to assure both satisfactory rotary-positional fixation and, when the pulse transducer is inserted, a precise rotary-position signal. In the event that there is no holder element in the apparatus, the angle-indicator marking can also be used later for the purpose of optical relocation of the predetermined rotary position.

In a position-fixing apparatus in which the element firmly connected with the drive shaft is a cylindrical sheet-metal cage of a flyweight assembly of a governor mounted on the injection pump, as in the subject of German Pat. No. 24 38 313 or corresponding British Pat. No. 1507902, the angle marking can be produced in a very cost-favorable and functionally reliable manner by the application of the characteristics disclosed in claim 3. As a result of the characteristics disclosed in claim 4, positional tolerances between the protrusion and the apparatus are compensated for and have no influence on the rotary-position signal or the position-fixing function of the apparatus.

In a position-fixing apparatus of the general type disclosed in the preamble to the main claim (German Offenlegungsschrift No. 20 00 997) or corresponding U.S. Pat. No. 3,702,577, whose apparatus housing, at the level of the axis of the drive shaft, is flanged to a housing portion firmly connected with the pump housing and has a securing flange with oblong securing slots which extend lengthwise in a direction perpendicular to the drive shaft, the initial adjustment of the apparatus housing relative to the housing portion firmly connected with the pump housing is attained in an advantageous manner by applying the characteristics disclosed in claim 7. A precise adjustment of the position of the apparatus housing is possible if the associated adjusting tool is embodied in accordance with the characteristics of claim 8. Finally, the characteristics of claim 9 enable the adjustment to be performed in an automated manner.

The invention will be better understood and further objects and advantages thereof will become more apparent from the ensuing detailed description of a preferred embodiment taken in conjunction with the drawings.

DESCRIPTION OF THE PREFERRED EMBODIMENT

Figure 1:
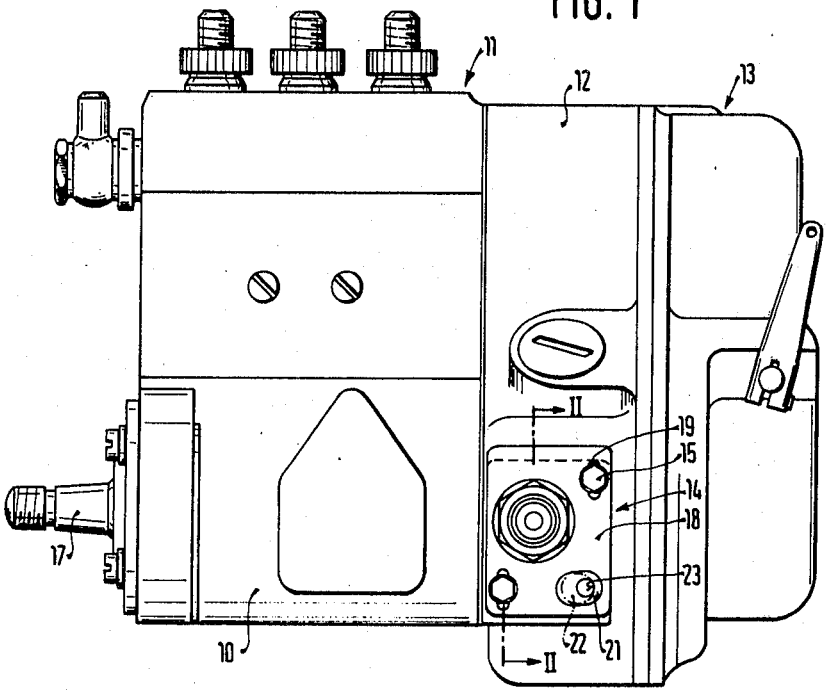
FIG. 1 is a side elevational view, in reduced scale, of the fuel injection pump provided with a position-fixing apparatus in the region of the governor.

In FIG. 1, a position-fixing apparatus 14 having securing screws 15 embodied as having breakaway heads is secured on a housing portion firmly connected with the pump housing 10 of a fuel injection pump. As can be seen in more detail in FIG. 2, the apparatus 14 has an apparatus housing 16 which is flanged, at the level of the axis of a drive shaft 17 of the injection pump 11, onto the governor housing 12 firmly connected with the pump housing 10 and has a securing flange 18 with oblong securing slots 19. These oblong securing slots 19 extend lengthwise in a direction perpendicular to the drive shaft 17; as a result, it is possible to perform a displacement of the apparatus housing 16 as described further below. Besides the oblong securing slots 19, the securing flange or apertured plate member 18 has an additional oblong slot 21 (see FIG. 1), which extends lengthwise in a direction perpendicular to that of the oblong securing slots 19 and parallel to the longitudinal axis of the drive shaft 17. This additional oblong slot 21 serves as an access point for an adjusting tool 22 indicated in FIG. 1 by dotdash lines. If it is necessary to perform a positional displacement of the apparatus 14, this adjusting tool 22 is inserted not only into the oblong slot 21 but also into a fixation bore 23 disposed in the governor housing 12 in the vicinity of the oblong slot 21.

Figure 4:
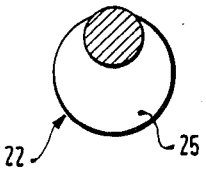
FIG. 4 is a section through this adjusting tool taken along the line IV—IV of FIG. 3.
Figure 3:
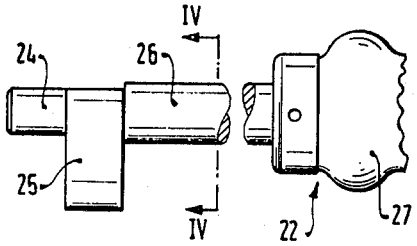
FIG. 3 is an interrupted side view of the associated adjusting tool.

The adjusting tool 22, which is shown in greater detail in FIGS. 3 and 4, includes at its outermost end a fixation pin 24 which can be inserted into the fixation bore 23. Adjoining the fixation pin 24 is an adjusting cam 25, which cooperates with the oblong slot 21 in the securing flange 18 of the apparatus housing 16. In order to be able to actuate the adjusting tool 22 in a sensitive manner, a handgrip 27 is disposed on the shaft portion 26; this handgrip 27 may also be embodied as needed in the form of a lever. In order to perform an automated adjustment, the adjusting cam 25 may also be motor-driven by the servomotor of an automated adjusting device (not shown).

The apparatus housing 16 which is flanged onto the governor housing 12 (see FIG. 2) carries a holder element 30 having a guide bore 29 adapted to receive a holder pin 31. The flange 42 on the holder element 30 is received in a reception bore 28 disposed perpendicular to the axis of the drive shaft 17. The holder pin 31 protrudes out of the apparatus housing 16, that is, out of its guide sleeve 29, and into the interior of the governor housing 12. A groove 33 machined into the end face 32 of the holder pin 31 engages a protrusion 35 disposed on an element 34 which is firmly connected with the drive shaft 17 and serves as a supply onset or angle-indicator marking. The holder pin 31 is subject to the force of a compression spring 36 which is supported in the guide sleeve 29, and thus keeps the drive shaft 17 of the injection pump 11 locked in the initially established rotary position in the desired manner. The cross section of the groove 33 disposed on the end face is widened in trapezoidal form toward the protrusion 35, so that even when the apparatus housing 16 is displaced upward or downward by a few millimeters the groove 33 still fixes the protrusion 35 in position in a satisfactory manner.

In the illustrated embodiment, the element 34 firmly connected with the drive shaft 17 is embodied by a sheet-metal cage of a flyweight assembly 37 of the rpm governor 13 mounted on the injection pump 11. The protrusion 35, which serves as a supply-onset marking and protrudes out of the surfce 38 of the sheet-metal cage 34 comprises a tongue which is bent at right angles out of a cylindrical wall 39 of the sheet-metal cage 34. The protrusion 35 has a rectangular end face 41 (more clearly shown in FIG. 5) which points radially outward from the drive shaft 17, and its longer edges, extending perpendicular to the plane of the drawing, extend parallel to the longitudinal axis of the drive shaft 17 and are at least twice as long as the edges which are indicated in the drawing by the letter a, which extend in the circumferential direction of the sheet-metal cage 34 and are determined by the thickness of the material comprising the protrusion 35.

Figure 2:
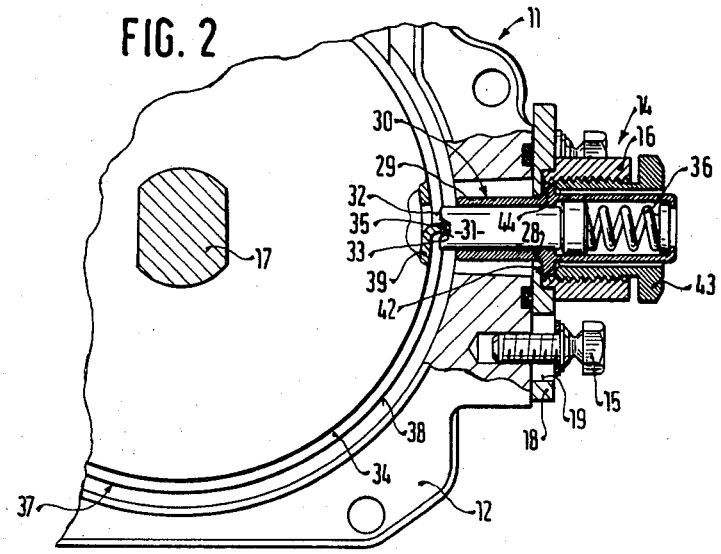
FIG. 2 is a partial cross-sectional view taken aong the line II—II of FIG. 4.
Figure 5:
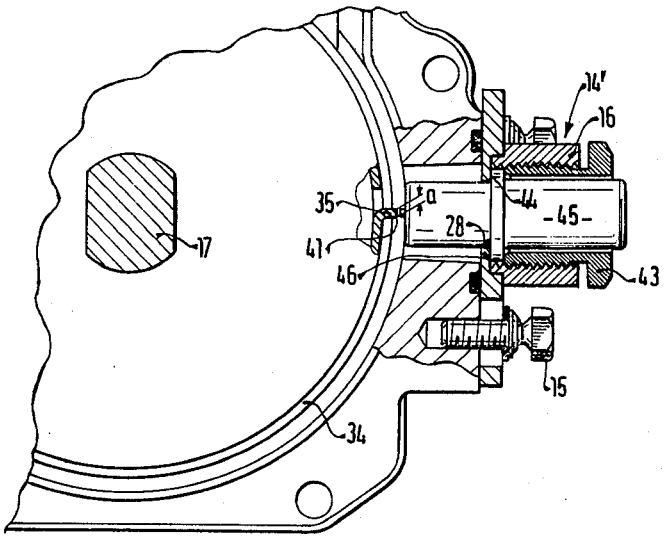
FIG. 5 is a partial cross-sectional view corresponding to that of FIG. 2, but with the electric pulse transducer inserted into the apparatus housing.

With a holder element 30 inserted into the apparatus 14 as shown in FIG. 2, a contact shoulder 42 of the guide sleeve 29 is held tightly against a step 44 of the reception bore 28 by a sleeve screw 43 acting as a securing means. In order to measure the supply onset, or a rotary position of the drive shaft 17 corresponding to or associated with the supply onset, the holder element 30 can be removed from the apparatus housing 16, after the sleeve screw 43 has been removed, and then replaced as shown in FIG. 5 by an electric pulse transducer 45 functioning in a non-contacting manner. The pulse transducer 45 is then held tightly against the step 44 in the apparatus housing 16 by the sleeve screw 43 with a contact shoulder 46. In this type of usage shown in FIG. 5, the protrusion 35 acts in accordance with the invention as a pulse trigger for the pulse transducer 45, which serves to ascertain the predetermined rotary position. A control and measurement unit which is known per se and is accordingly not shown in detail adjoins the pulse transducer 45 and is calibrated in such a manner that the desired rotary-position signal is measured at a predetermined rpm, such as 1000 rpm, and is indicated whenever the protrusion 35 is located precisely in the axial center of the pulse transducer 35.

The mounting of the apparatus according to the invention, as well as its mode of operation, will now be described.

The apparatus housing 16 of the position-fixing apparatus 14 is mounted by means of the securing screw 15 on the governor housing 12; it is tightened only to such an extent that it can be displaced upward or downward, out of the central position in which it is initially mounted, by the adjusting tool 22 inserted into the oblong slot 21. (See FIG. 1). In order to establish the initial central mounting position of the apparatus 14, the pulse transducer (FIG. 5) is inserted into the reception bore 28, and the apparatus housing 16 is displaced by the adjusting tool 22 in a direction which is tangential to the circumference of the sheet-metal cage 34 to such an extent that and until such time as the control device indicates the desired measurement value, at which the protrusion 35 is in the desired rotary position of the drive shaft 17 and the axial center of the pulse transducer 45 is located precisely opposite this protrusion 35. In this now-ascertained position, the apparatus housing 16 is firmly held by the securing screws 15. The heads of these screws 15, which in this case have a hexagonal shape, can be broken away, thus preventing a subsequent, unauthorized adjustment of the apparatus, which is indicated in FIG. 5 by reference numeral 14' in FIG. 5 and has the pulse transducer 45 installed. Subsequently, the pulse transducer 45 is removed and the holder element 30 is reinserted. After the injection pump 11 is mounted on the engine, the drive of which has previously been set in a position corresponding to the initial adjustment of the injection pump 11, the holder element 30 is removed and the reception bore 28 of the apparatus housing 16 is closed with a closure screw (not shown) inserted in place of the sleeve screw 43.

If it is desired to re-check the rotary position of the injection pump drive shaft 17 corresponding to or associated with the supply onset after the pump has been mounted on the engine, which may become necessary during servicing after the engine has been in operation for a certain amount of time, then all that is needed is to insert the pulse transducer 45 into the apparatus housing 16 and to check the measurement signal against a top-dead-center marking located on the engine, which is preferably capable of being picked up electrically.

After repairs have been performed on the injection pump, the rotary position of the injection pump drive shaft 17 associated with the supply onset can be relocated, for the purpose of remounting the pump on the engine, in a simple manner without using a test bench. This is done by rotating the drive shaft 17 until the protrusion 35, acting as an angle-indicator marking, is located precisely in the axial center of the reception bore 28. At this time, the holder element 30 can be inserted and the pump re-mounted on the engine.

Filed concurrently herewith is a companion application Ser. No. 213712, now U.S. Pat. No. 4,348,895 in the name of Straubel et al entitled "Method For Angularly Correct Mounting Of A Fuel Injection Pump On An Internal Combustion Engine" which is also assigned to the assignee of this application.

The foregoing relates to a preferred exemplary embodiment of the invention, it being understood that other embodiments and variants thereof are possible within the spirit and scope of the invention, the latter being defined by the appended claims.

What is claimed and desired to be secured by Letters Patent of the United States is:

1. An apparatus for positionally fixing a drive shaft disposed in a fuel injection pump for internal combustion engines in a predetermined rotary position relative to the onset of fuel supply, a position fixing apparatus fixed relative to a pump housing, said apparatus further including a holder element which is adapted to protrude out of said apparatus housing, said holder element associated with a pin means for axial displacement thereof, and means cooperating with said drive shaft by means of which said drive shaft may be held in said predetermined rotary position, characterized in that said means cooperating with said drive shaft is firmly connected with said drive shaft, said means further including an angle-indicator means for positionally fixing said drive shaft, said angle-indicator means further including cooperative means which is inserted into said apparatus housing whereby the predetermined rotary position of the drive shaft may be ascertained.

2. An apparatus as defined in claim 1, characterized in that said cooperative means comprises said holder element associated with said pin means engaging said angle indicator means for constant fixation of a previously established correlation of said drive shaft rotary position relative to the onset of the fuel supply.

3. An apparatus as defined by claim 1, characterized in that said means cooperating with said drive shaft further includes an offstanding element firmly connected with said drive shaft, said offstanding element arranged to engage a groove in said pin means when said pin means is displaced in an axial direction.

4. An apparatus as defined in claim 3, in which said means cooperating with said drive shaft comprises a cylindrical sheet-metal cage cooperating with a flyweight assembly of an rpm governor mounted on said injection pump, characterized in that said offstanding element comprises a tongue which is bent at right angles out of said cylindrical wall of said sheet-metal cage.

5. An apparatus as defined by claim 4, characterized in that said offstanding element has a rectangular end face, said end face longer further including longer edges which are parallel to the longitudinal axis of said drive shaft and are at least twice as long as the edges which extend in the circumferential direction of said sheet-metal cage.

6. An apparatus as defined by claim 1, characterized in that said pin means is received in a guide sleeve of said holder element thereby, whereupon a closure element is substituted for said removable assemblage.

7. An apparatus as defined by claim 1, characterized in that said holder element is held tightly in said apparatus housing by a securing means comprising a sleeve nut.

8. An apparatus as defined by claim 1, characterized in that said apparatus housing is supported in an apertured plate member, further wherein at least one of said apertures in said plate member includes an elongated slot means, said elongated slot means arranged in a direction parallel to said drive shaft and cooperative with tool means for adjustment of said plate member.

9. An apparatus as defined by claim 8, characterized in that said adjusting tool means includes a locating pin means and an axially spaced adjusting cam member, said locating pin means arranged to be inserted in a locating bore in said pump housing, and said cam cooperating with said elongated slot, whereby controlled adjustments of said plate member relative to said pump housing can be performed.

10. An apparatus as defined by claim 7, characterized in that the adjusting tool is actuatable by a servomotor of an automated adjusting device.

11. An apparatus as defined by claim 1, characterized in that said cooperative means of said angle indicator means includes cooperative electric pulse transducer means for replacing said pin means associated with said holder element.

* * * * *